US007681348B1

(12) United States Patent
Saylor

(10) Patent No.: US 7,681,348 B1
(45) Date of Patent: Mar. 23, 2010

(54) VARIABLE SIGNALING DEVICE

(76) Inventor: Will Saylor, 1215 Ridgemont St., Round Rock, TX (US) 78664

( * ) Notice: Subject to any disclaimer, the term of this patent is extended or adjusted under 35 U.S.C. 154(b) by 34 days.

(21) Appl. No.: 11/932,787

(22) Filed: Oct. 31, 2007

Related U.S. Application Data

(60) Provisional application No. 60/855,489, filed on Oct. 31, 2006.

(51) Int. Cl.
*G09F 21/02* (2006.01)

(52) U.S. Cl. ..... 40/586; 40/606.14; 116/174

(58) Field of Classification Search ..... 40/492, 40/586, 412, 612, 606.14, 606.15; 116/173, 116/174, 63 P
See application file for complete search history.

(56) References Cited

U.S. PATENT DOCUMENTS 3,318,279 A * 5/1967 Padilla ..... 116/63 R
4,949,525 A * 8/1990 Weaver ..... 40/606.14
4,982,683 A * 1/1991 Earnest, Jr. ..... 116/63 P
5,809,930 A * 9/1998 Brooks ..... 116/174
6,363,637 B1 * 4/2002 Birmingham ..... 40/440
6,609,476 B1 * 8/2003 Lorenzana et al. ..... 116/173
6,665,967 B1 * 12/2003 Quackenbush ..... 40/588
6,796,062 B1 * 9/2004 deKoevend ..... 40/586

OTHER PUBLICATIONS

Texas Department of Transportation, Texas Department of Transportation (TXDOT) Traffic Control Plan (TCP) TTP TCP-2-04 for 2 Lane, Undivided with Shoulders.
Department of Transportation, Federal Highway Administration, Manual on Uniform Traffic Control Devices, Nov. 2003, Claitors Publishing Division, Section 6E.01- Section 6E.05.

* cited by examiner

*Primary Examiner*—Joanne Sibermann
*Assistant Examiner*—Shin Kim
(74) *Attorney, Agent, or Firm*—Scheinberg & Griner, LLP; Michael O. Scheinberg; David Griner

(57) ABSTRACT

An improved device for signaling traffic on roadways including a fixed display surface with one or more additional display surfaces rotatably attached, such that different indicia can be displayed to motorists. A rotation grip allows an operator to manually change the position of the additional display surfaces. This manual adjustment ensures the operator is displaying the appropriate messages not only to oncoming traffic but also to traffic approaching from the rear.

10 Claims, 7 Drawing Sheets

VARIABLE SIGNALING DEVICE

TECHNICAL FIELD OF THE INVENTION

The present invention relates to devices for signaling traffic and more particularly to a signaling device capable of selectively displaying variable indicia.

BACKGROUND AND SUMMARY OF THE INVENTION

Under certain road conditions, such as on undivided two-way roads, a flagman uses a STOP/SLOW sign (paddle) to control traffic.

One side of the paddle displays a "STOP" message, and the other side of the paddle displays a "SLOW" message. When controlled traffic is shown the "STOP" side of the paddle, opposing traffic is shown the "SLOW" side of the paddle. This is, in most cases, not only acceptable, but also desirable. In some cases, a flagman wants to control traffic in one direction only. The flagman faces oncoming traffic and displays the paddle, regulating oncoming traffic without intending to regulate traffic traveling in the opposite direction (opposing traffic). However, opposing traffic can be unintentionally regulated because the STOP/SLOW paddle is in full view from both directions. When controlled traffic is shown the "SLOW" side of the paddle, an unintentional and potentially dangerous consequence is that opposing traffic is shown the "STOP" side of the paddle. While the flagman does not intend to convey a "STOP" message to opposing traffic, the message is conveyed. A motorist may see the "STOP" sign and stop, creating the potential for rear-end collisions and chain reaction pile-ups.

An illustration is the Texas Department of Transportation (TXDOT) Traffic Control Plan (TCP) TTP TCP-2-04 for 2 Lane, Undivided with Shoulders scenarios. While performing motorist surveys using this TCP, vehicles must be brought to a full stop to allow surveys to take place. When oncoming vehicles are shown the "SLOW" sign, opposing traffic can clearly see the backside of the STOP/SLOW paddle displaying a "STOP" sign.

The Manual on Uniform Traffic Control Devices (MUTCD) is the Federal Highway Administration's guide to traffic signs, barriers, construction zone traffic control plans, and similar items. The specifications for STOP/SLOW paddles are in Chapter 6, Section 6E. These specifications can be found at the following URL:

http://mutcd.fhwa.dot.gov/HTM/2003/part6/part6e.htm

These federal government specifications provide guidance for flaggers, including apparel, signaling devices like STOP/SLOW paddles, flagger procedures, and flagger stations. However, the MUTCD does not address the issue of motorists unintentionally being shown a "STOP" message.

Therefore, there is a need for a signaling device which allows a flagman to effectively control the messages displayed to both directions of traffic.

SUMMARY OF THE INVENTION

An object of the invention is to provide an effective means for an operator, such as a flagman, to selectively display an appropriate message.

The current invention is a signaling device in which the indicia displayed on at least one side can be changed. In some embodiments, the indicia displayed on both sides of the signaling device can be changed.

The foregoing has outlined rather broadly the features and technical advantages of the present invention in order that the detailed description of the invention that follows may be better understood. Additional features and advantages of the invention will be described hereinafter. It should be appreciated by those skilled in the art that the conception and specific embodiments disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims.

BRIEF DESCRIPTION OF THE DRAWINGS

For a more thorough understanding of the present invention, and advantages thereof, reference is now made to the following descriptions taken in conjunction with the accompanying drawings, in which.

DETAILED DESCRIPTION OF PREFERRED EMBODIMENTS

Figure 1:
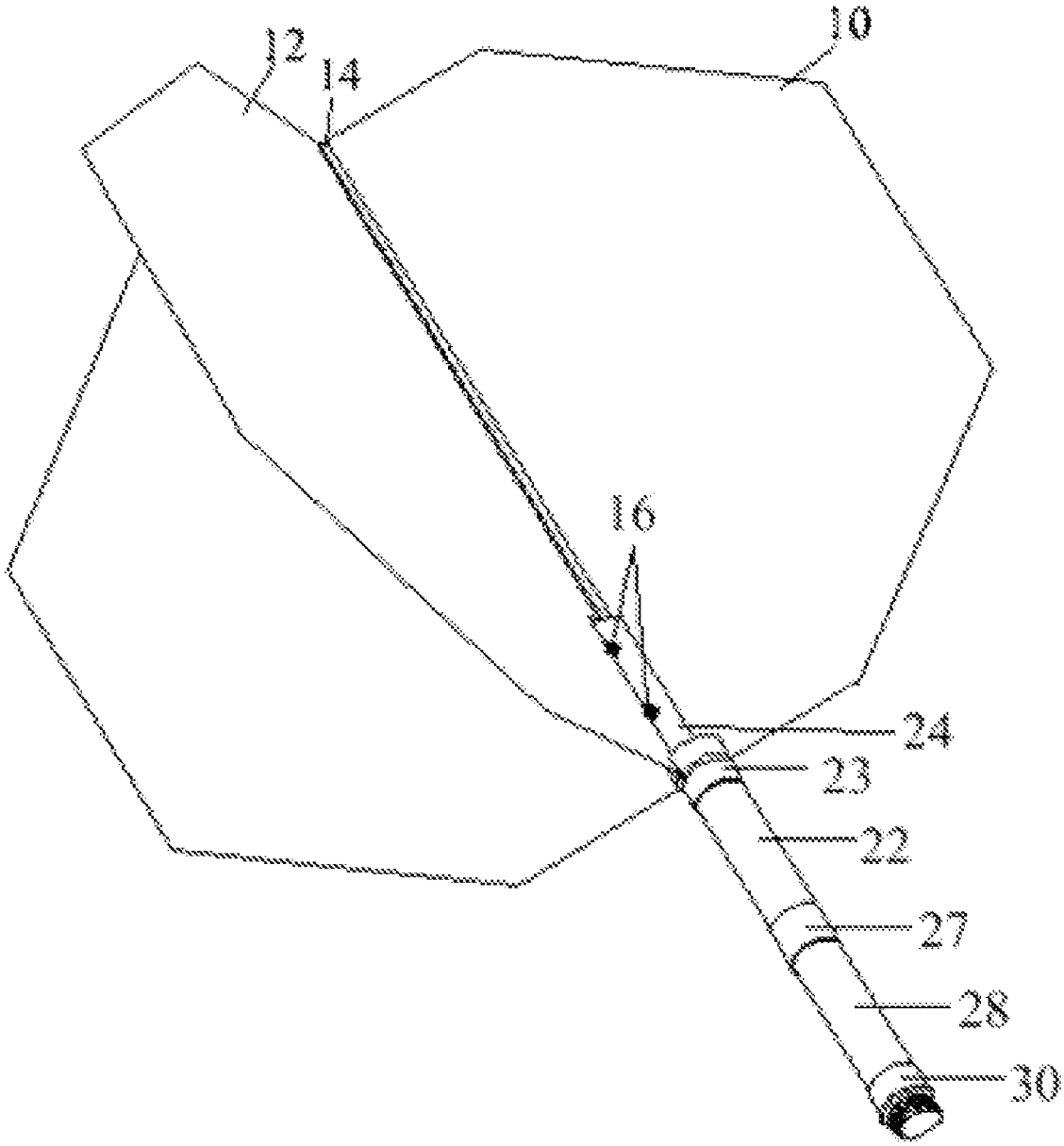
FIG. 1 is a view of an embodiment of a signaling device showing a typical handheld configuration.

Preferred embodiments of the present invention provide a signaling device that allows a flagman to display a message to traffic approaching from one side, while allowing the flagman to easily change the message on the opposite side of the signaling device. For example, the flagman can display a "SLOW" message to traffic approaching from the rear, while being able to change the message to "SLOW" or "STOP" for oncoming traffic. This would prevent the unintended and dangerous consequences of displaying a "STOP" message to traffic approaching from the rear, when the flagman does not intend for those motorists to see that message.

In one embodiment, a post holds up a first display support, which is a flat octagonal sheet having a first display surface on one side and a second display surface on the opposite side. A "SLOW" message is displayed on the first display surface. The second display surface displays the letters "SL" on the first half and the letters "OP" on the second half. A second display support, rotatably attached to the first display support, includes a third and a fourth display surface on opposite sides of the second display support. The third display surface displays the letters "OW" and the fourth display surface displays the letters "ST". The second display support is attached to a rotation grip, allowing the flagman to manually vary the message between "STOP" and "SLOW" by turning the grip, thereby exposing either message as described below.

When the second display support is in a first rotational position, the first half of the second display surface displaying "SL" is visible, and the third display surface displaying "OW" is visible. The second half of the second display surface is hidden behind the second display support. This forms a complete "SLOW" message to motorists. To change the message, the flagman turns the rotation grip.

When the second display support is in a second rotational position, the fourth display surface displaying "ST" is visible, and the second half of the second display surface showing "OP" is visible. The first half of the second display surface is hidden behind the second display support. This forms a complete "STOP" message to motorists.

In another embodiment, a crossing guard can change the message displayed to both directions of traffic. This would be accomplished by adding a rotatably attached third display support on the side of the first display support that is opposite to the side on which the rotatably attached second display support is located. Both the rotatably attached display supports are attached to a rotation grip, allowing the crossing guard to manually vary both messages by turning the grip. The crossing guard can display a "STOP" message to both directions of traffic while children are crossing and display a "SLOW" message to both directions of traffic at other times by turning the grip.

The signaling device can also be attached to a lower support shaft. The lower support shaft would be long enough for the operator to rest the device on the ground or in a stand while in use.

Figure 3:
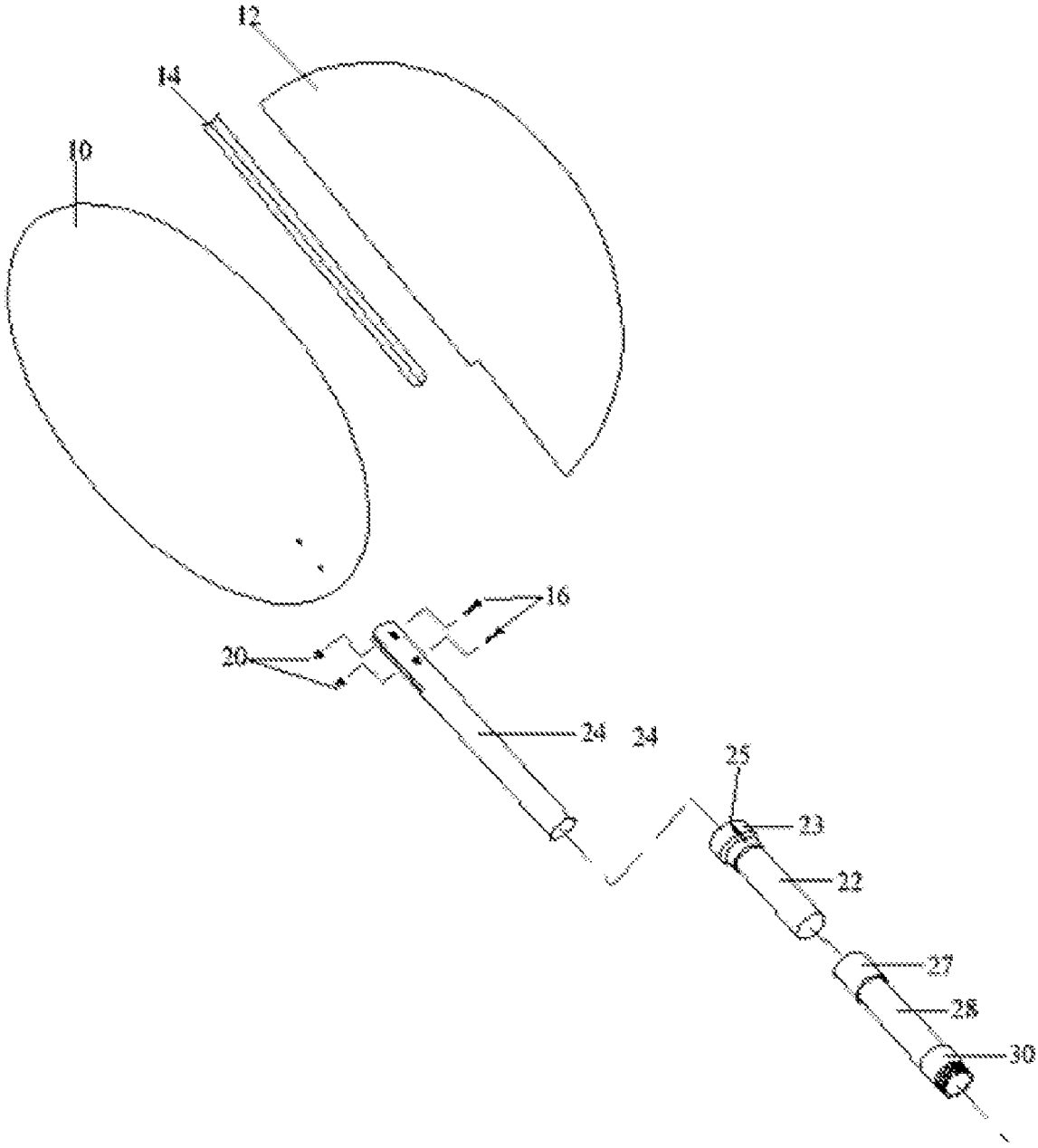
FIG. 3 is an exploded view of all of the components of the handheld signaling device shown in FIG. 1.

FIGS. 1 and 3 show a preferred embodiment of the present invention, including a first display support 10, a second display support 12 rotatably attached to the first display support 10, and a rotation grip 22.

First display support 10 displays a static message (not shown) to one direction of traffic, while allowing an operator the ability to manually change the message displayed to the opposite direction of traffic by way of rotating second display support 12. For example, a flagman could display a "SLOW" message to one direction of traffic (on the static message side of first display support 10); and display either a "SLOW" message or a "STOP" message to oncoming traffic, by manually adjusting the second display support 12 using the rotation grip 22.

Figure 4:
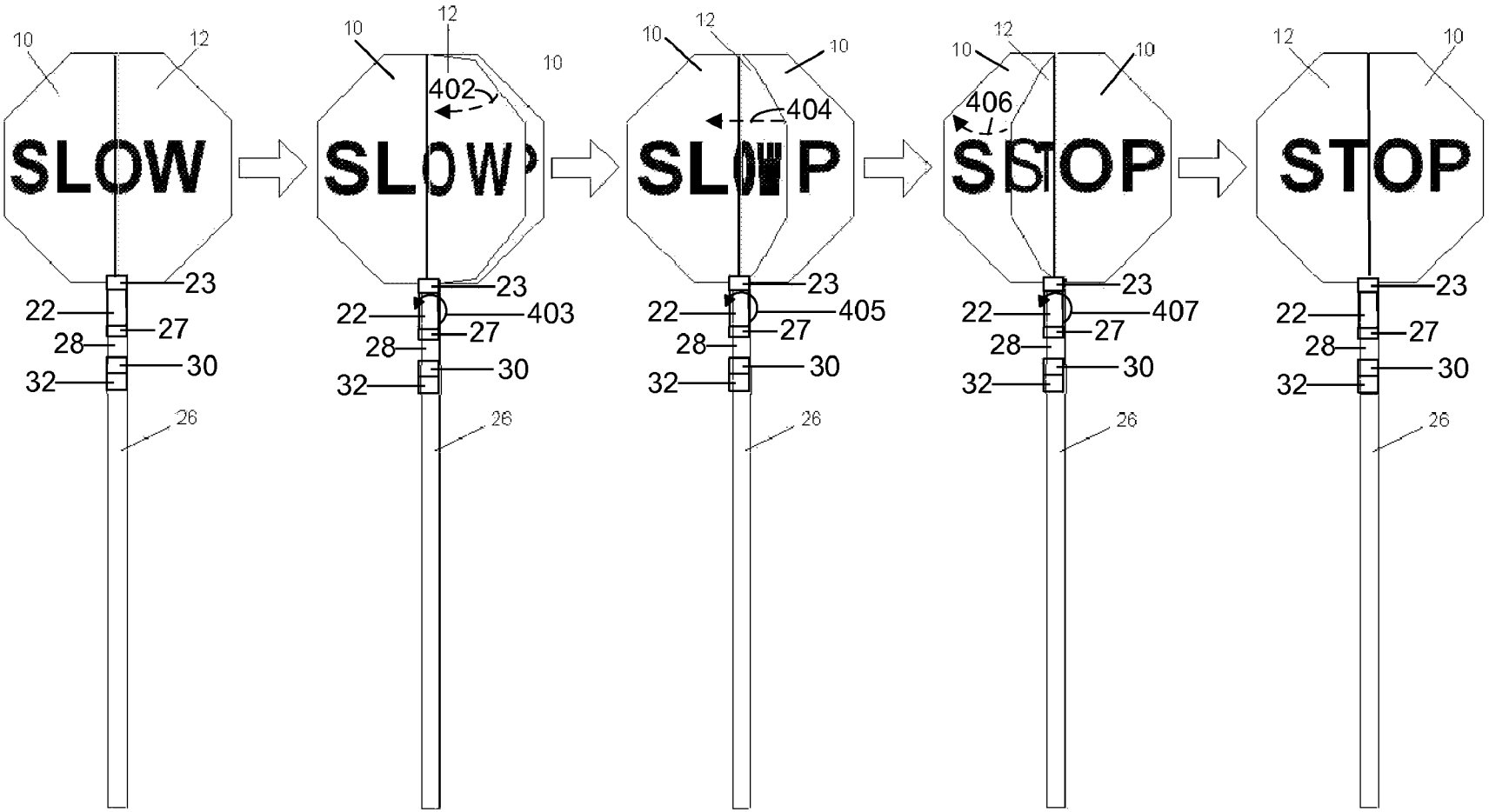
FIG. 4 illustrates the process of rotating the second display support with respect to the first display support, with a "SLOW" message changed to a "STOP" message by way of counter-clockwise rotation of the rotation grip with respect to the first display support.

The first display support 10 is connected to a support shaft 24 using standard bolts 16, washers 18 and nuts 20 (FIG. 3). Support shaft 24 is cylindrical, with one half of the cylinder removed at one end to provide a plane, defined by the cross-sectional tube walls to attach the first display support. On one side of the first display support 10, the static message "SLOW" is displayed (not shown). The other side of the first display support 10 displays the left side of a standard "SLOW" message and the right side of a standard "STOP" message. This is illustrated in FIG. 4. A hinge 14 is connected to the first display support 10 along its vertical axis and also connected to a second display support 12 (FIG. 1 and FIG. 3). The second display support has the right side of a standard "SLOW" message on one surface and the left side of a standard "STOP" message on the opposite surface. This is illustrated in FIG. 4. Rotating the second display support 12 in a clockwise direction shown by directional arrows 402, 404 and 406 with respect to the first display support 10 forms a complete "SLOW" message. Similarly, rotating the second display support 12 in a counterclockwise direction with respect to the first display support 10 will form a complete "STOP" message. This is illustrated in FIG. 4.

Figure 7:
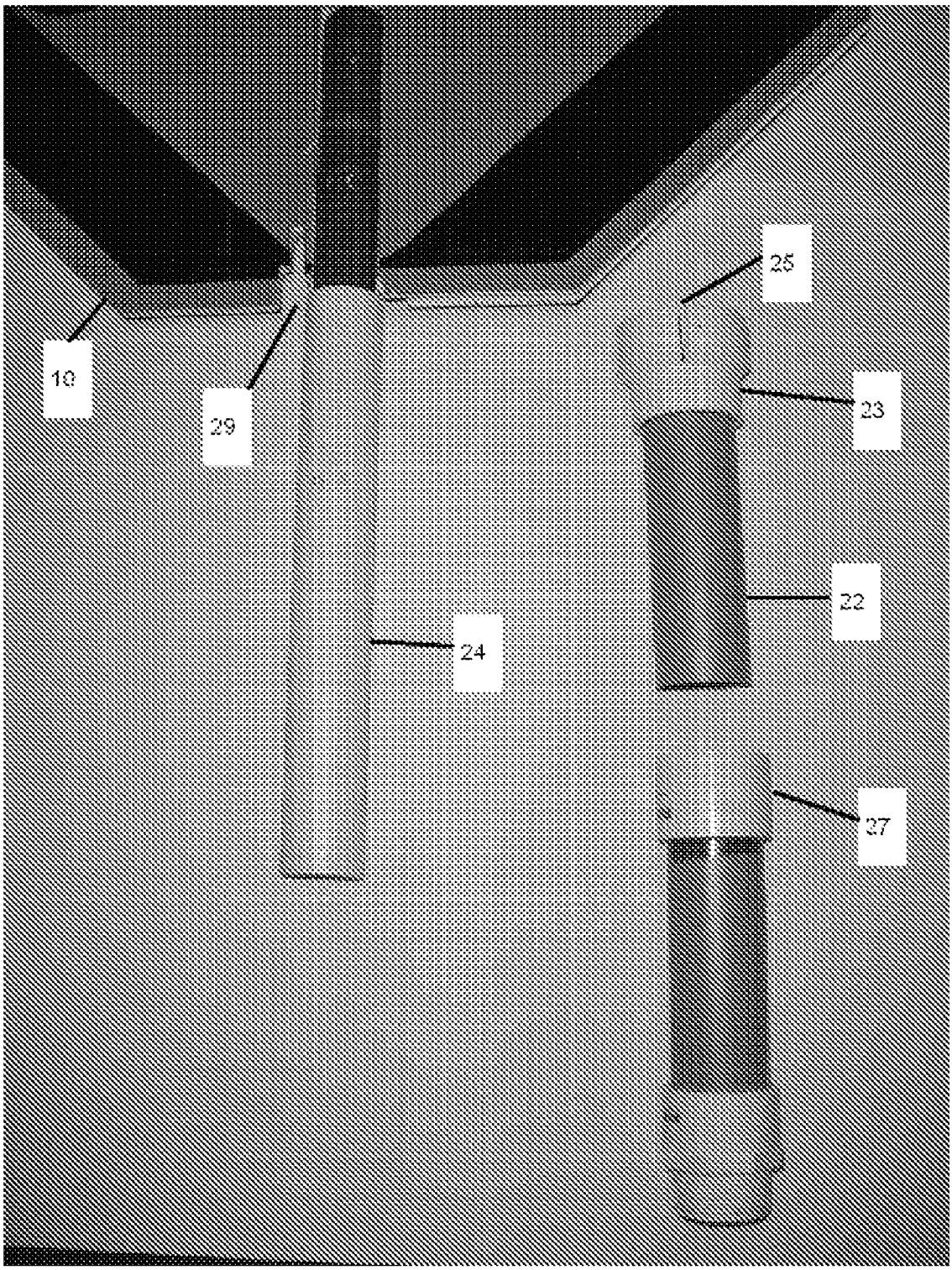
FIG. 7 is a view of an embodiment of the rotation collar, rotation grip, slip collar, connecting sleeve, and coupling collar disconnected from the support shaft.

The rotation of the second display support 12 is accomplished by manually turning a rotation grip 22 (FIG. 1 and FIG. 3). The rotation grip 22 is cylindrical and slightly larger than the support shaft 24 (FIG. 3). The rotation grip 22 is positioned on the outside of the support shaft 24, allowing for free rotation around the support shaft 24 (FIG. 3). One end of the rotation grip 22 is connected to the second display support 12 via a rotation collar 23 (FIG. 7), such that when the rotation grip 22 moves around the support shaft 24 the second display support 12 is repositioned with respect to the first display support 10. The second display support 12 fits into grooves 25 of the rotation collar 23 (FIG. 7). The diameter of the rotation collar 23 should be large enough to provide sufficient contact between the grooves 25 and the surfaces of the second display support 12 so that rotation is possible without causing undue stress and possible damage to the second display support 12. On the other hand, the diameter of the rotation collar 23 should not be so large that the cut-out 29 at the base of the first display support 10 structurally weakens the signaling device or obscures the surfaces of the first display support 10. When rotation grip 22 is rotated clockwise, as shown by directional arrows 403, 405 and 406, the display message "SLOW" is changed to "STOP" message.

The rotation grip 22 fits snugly inside the rotation collar 23 (FIG. 7). The rotation grip 22 with attached rotation collar 23 fits over the support shaft 24 such that the groove 25 in the rotation collar 23 contacts the edges of the second display support 12 and fits inside the cut-outs 29 on the first display support (FIG. 7).

The rotation grip 22 is supported by a connecting sleeve 28 using a slip collar 27 (FIG. 7). The slip collar 27 supports the rotation grip 22 while not affecting its rotation ability. The other end of the slip collar 27 fits snugly around the connecting sleeve 28 (FIG. 7). The other end of the connecting sleeve 28 fits snugly inside a coupling collar 30 (FIG. 1, FIG. 3 and FIG. 7). The support shaft 24 fits snugly inside the coupling collar 30 (FIG. 3). The operator can grip the connecting sleeve 28 or the coupling collar 30 with one hand and use the other hand to move the rotation grip 22.

Figure 5A:
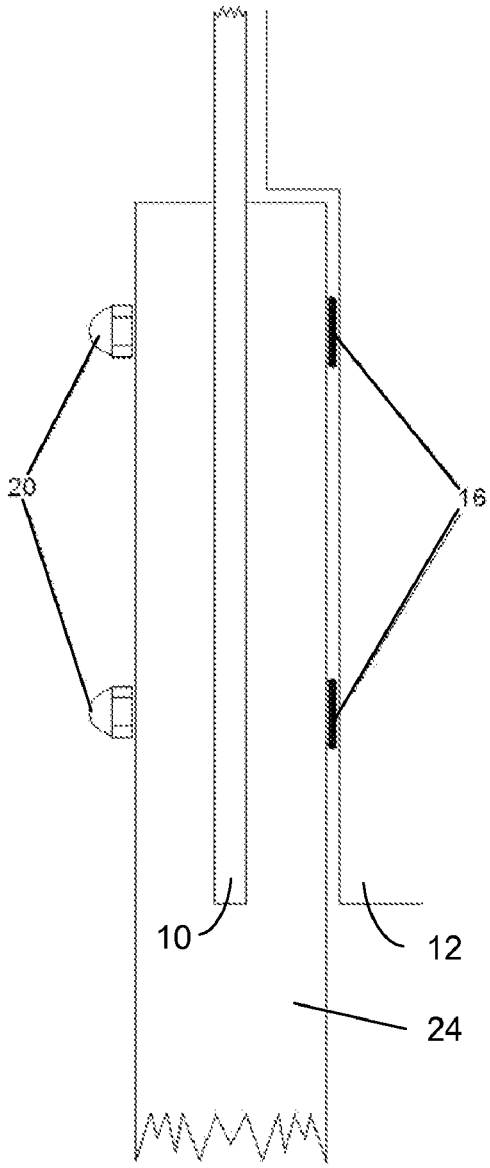
FIGS. 5A and 5B illustrate an embodiment of a signaling device with a detailed view of the connection area between the rotation grip and the first and second display supports.
Figure 5B:
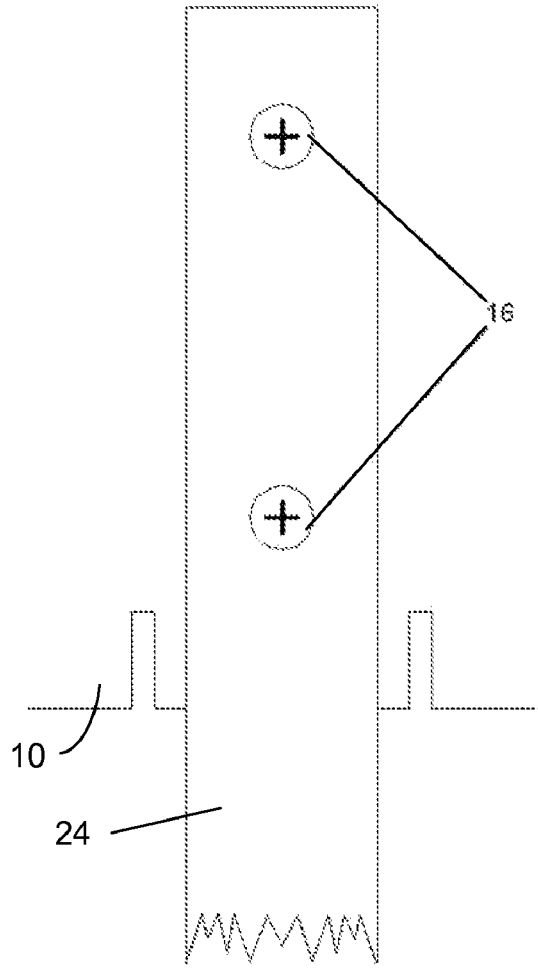
Figure 6A:
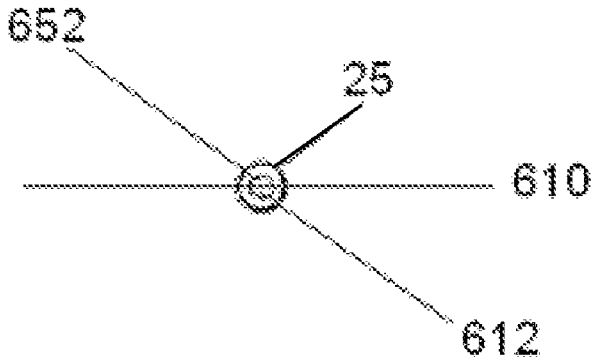
FIGS. 6A and 6B illustrate an alternate embodiment, where the rotation grip is attached to two display supports which simultaneously change messages on both sides of the first display support.
Figure 6B:
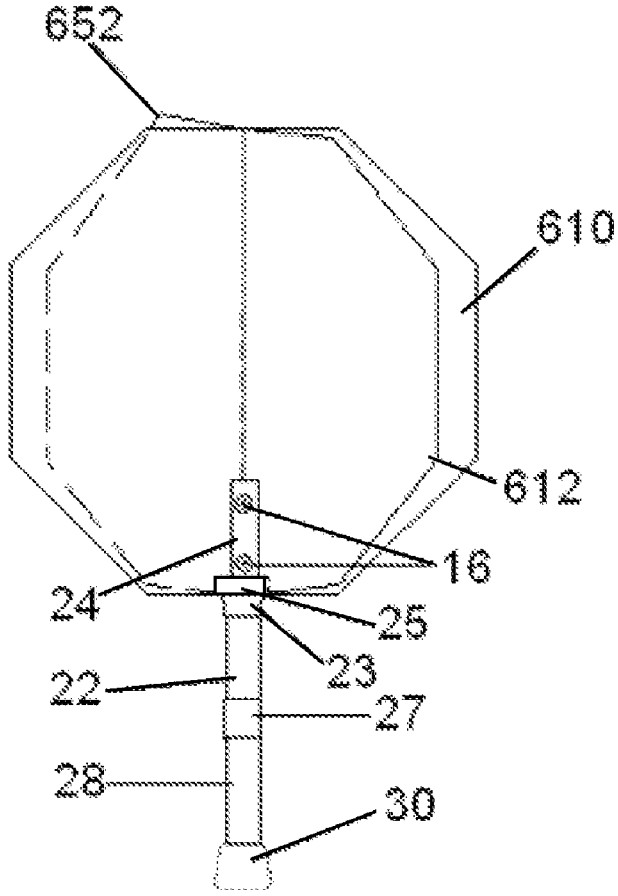

FIGS. 6A and 6B show another preferred embodiment of the present invention which contains rotatably attached display supports (612 and 652) on both sides of the first display support 610, allowing the operator to manually change the messages on both sides of the sign simultaneously. For example, a school crossing guard could simultaneously display either a "SLOW" or "STOP" message to both directions of traffic, by rotating both display supports simultaneously. The device would be similar to the one shown in FIG. 7, but there would be grooves 25 on both sides of the coupling collar 23, allowing a connection to the edges of a third display support on the side of the first display support 10 that is opposite to the side on which the second display support 12 is located. In the embodiment shown in FIG. 6, the support shaft 24 is tapered to allow for maximum stability of the first display support 610 allowing the grooves 25 to contact the second and third display supports (612 and 652) away from the edges because the cutout region of the display supports (612 and 652) slopes inward, allowing the vertical grooves to "bite" more of the display supports, while minimizing the amount of the first display support 610 surface obscured by the support shaft 24. FIGS. 5A and 5B show an enlarged viewed of this tapered support shaft 24 connected to the first display support 10.

Figure 2:
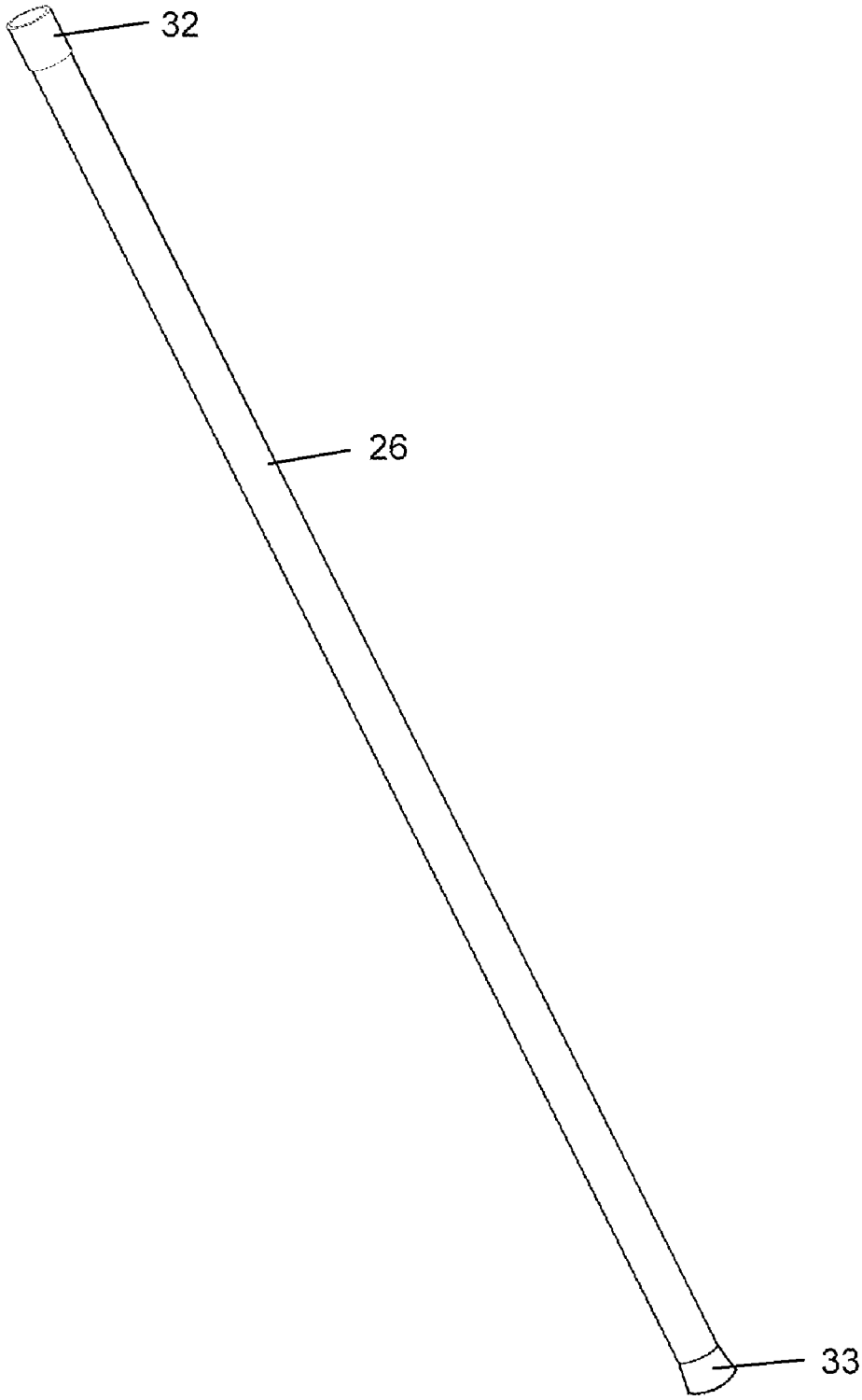
FIG. 2 is a view of a lower support shaft which can be attached to the handheld signaling device shown in FIG. 1 to allow for elongation of the signaling device.

FIG. 2 shows a lower support shaft 26 which is connected to the handheld signaling device of FIG. 1 to allow for elongation of the signaling device. The lower support shaft would be long enough for the operator to rest the device on the ground or in a stand while in use. A male, threaded coupling collar 30 in FIG. 1 connects with a female, threaded coupling collar 32 in FIG. 2. The lower support shaft 26 fits snugly inside this female, threaded coupling collar 32. In one embodiment, the lower support shaft 26 contains an end part rubber bumper 33 at its base.

It will be understood that the invention includes more than one novel aspect. Different embodiments can be constructed for different purposes using any of, or combination of, the different aspects of the invention, and not all the advantages of the invention are, therefore, necessarily achieved by every embodiment that is within the scope of the attached claims.

Although the present invention and its advantages have been described in detail, it should be understood that various changes, substitutions and alterations can be made herein without departing from the spirit and scope of the invention as defined by the appended claims. Moreover, the scope of the present application is not intended to be limited to the particular embodiments of the process, machine, manufacture, composition of matter, means, methods and steps described in the specification. As one of ordinary skill in the art will readily appreciate from the disclosure of the present invention, processes, machines, manufacture, compositions of matter, means, methods, or steps, presently existing or later to be developed that perform substantially the same function or achieve substantially the same result as the corresponding embodiments described herein may be utilized according to the present invention. Accordingly, the appended claims are intended to include within their scope such processes, machines, manufacture, compositions of matter, means, methods, or steps.

We claim as follows:

1. A signaling device having indicia that can be selectively displayed, comprising:

a first display support having, on opposite faces thereof, first and second display surfaces;

a second display support rotatably attached to the first display support, having, on opposite faces thereof, third and fourth display surfaces;

a rotation grip capable of rotating the second display support, and a support shaft, with the first display support attached to the support shaft, and the rotation grip placed on the outside of the support shaft and connected to the second display support, with the grip capable of rotating around the support shaft allowing movement of the second display support.

2. The signaling device according to claim 1, further comprising a coupling collar, with the support shaft and the rotation grip connected to the coupling collar allowing the support shaft to remain fixed while the rotation grip is capable of moving freely.

3. The signaling device according to claim 2, further comprising a slip collar between the rotation grip and the coupling collar.

4. The signaling device according to claim 2, in which the coupling collar is threaded such that it can be connected to a lower support shaft.

5. The signaling device according to claim 3, in which the coupling collar is threaded such that it can be connected to a lower support shaft.

6. A signaling device having indicia which can be selectively displayed, comprising:

a first display support having, on opposite faces thereof, first and second display surfaces;

a second display support rotatable attached to the first display support, having, on opposite faces thereof, third and fourth display surfaces;

a third display support rotatably attached to the first display support that is opposite to the side on which the second display support is located, having on opposite faces thereof fifth and sixth display surfaces;

a rotation grip capable of rotating the second and third display supports, and a support shaft, with the first display support attached to the support shaft, and the rotation grip placed on the outside of the support shaft and connected to the second and third display supports, with the grip capable of rotating around the support shaft allowing movement of the second and third display supports.

7. The signaling device according to claim 6, further comprising a coupling collar, with the support shaft and the rotation grip connected to the coupling collar allowing the support shaft to remain fixed while the rotation grip is capable of moving freely.

8. The signaling device according to claim 7, further comprising a slip collar between the rotation grip and the coupling collar.

9. The signaling device according to claim 7, in which the coupling collar is threaded such that it can be connected to a lower support shaft.

10. The signaling device according to claim 8, in which the coupling collar is threaded such that it can be connected to a lower support shaft.

* * * * *